US009494907B2

(12) United States Patent
Mizutani

(10) Patent No.: US 9,494,907 B2
(45) Date of Patent: Nov. 15, 2016

(54) WASTE TONER STORING CONTAINER, AND IMAGE FORMING APPARATUS INCLUDING WASTE TONER STORING CONTAINER

(71) Applicant: KYOCERA Document Solutions Inc., Osaka-shi, Osaka (JP)

(72) Inventor: Naoki Mizutani, Osaka (JP)

(73) Assignee: KYOCERA Document Solutions Inc., Osaka-shi (JP)

( * ) Notice: Subject to any disclaimer, the term of this patent is extended or adjusted under 35 U.S.C. 154(b) by 0 days.

(21) Appl. No.: 14/922,881

(22) Filed: Oct. 26, 2015

(65) Prior Publication Data

US 2016/0124378 A1 May 5, 2016

(30) Foreign Application Priority Data

Oct. 30, 2014 (JP) ..... 2014-221922

(51) Int. Cl.
*G03G 21/10* (2006.01)
*G03G 21/12* (2006.01)

(52) U.S. Cl.
CPC ..... *G03G 21/105* (2013.01); *G03G 21/10* (2013.01); *G03G 21/12* (2013.01); *G03G 2215/0132* (2013.01)

(58) Field of Classification Search
CPC .... G03G 21/10; G03G 21/12; G03G 21/105; G03G 2215/0132
See application file for complete search history.

(56) References Cited

U.S. PATENT DOCUMENTS 8,224,225 B2 * 7/2012 Sakurai ..... G03G 21/12 399/119
2010/0111582 A1 * 5/2010 Nishimura ..... G03G 21/105 399/360
2011/0123207 A1 * 5/2011 Sato ..... G03G 21/12 399/35

FOREIGN PATENT DOCUMENTS

JP 09152820 A 6/1997
JP 2008083630 A * 4/2008

* cited by examiner

*Primary Examiner* — David Gray
*Assistant Examiner* — Laura Roth
(74) *Attorney, Agent, or Firm* — Alleman Hall McCoy Russell & Tuttle LLP

(57) ABSTRACT

A waste toner storing container includes a container main body, a first conveyance portion, and a second conveyance portion. The container main body stores waste toner discharged from a plurality of image-carrying members provided in an image forming apparatus. The first conveyance portion is rotatably provided in the container main body and configured to, by being rotated, convey the waste toner toward one side in a direction along a rotation axis line. The second conveyance portion is rotatably provided below and parallel to the first conveyance portion in the container main body and configured to, by being rotated, convey the waste toner toward another side that is opposite to the one side.

2 Claims, 8 Drawing Sheets

WASTE TONER STORING CONTAINER, AND IMAGE FORMING APPARATUS INCLUDING WASTE TONER STORING CONTAINER

INCORPORATION BY REFERENCE

This application is based upon and claims the benefit of priority from the corresponding Japanese Patent Application No. 2014-221922 filed on Oct. 30, 2014, the entire contents of which are incorporated herein by reference.

BACKGROUND

The present disclosure relates to a waste toner storing container for storing waste toner discharged from an image-carrying member, and relates to an image forming apparatus that includes the waste toner storing container.

A cleaning device of an electrophotographic image forming apparatus includes a storing portion for temporarily storing the waste toner. The storing portion is provided with a screw. The waste toner stored in the storing portion is conveyed in one direction and is discharged to outside from a discharge portion of the storing portion. The discharge portion is connected to a waste toner storing portion, and the waste toner discharged from the discharge portion flows into a waste toner storing container and is stored therein.

Meanwhile, a color image forming apparatus that includes a plurality of photoconductor drums includes a plurality of cleaning devices. In addition, the color image forming apparatus includes an intermediate transfer belt (image-carrying member) configured to carry a color toner image which is formed from toner images of a plurality of colors transferred from the photoconductor drums. The color toner image is transferred from the intermediate transfer belt to a recording medium by a transfer device. At this time, toner that has not been transferred to the recording medium remains on a surface of the intermediate transfer belt, too. As a result, the color image forming apparatus includes a cleaning device for removing the toner that has remained on the intermediate transfer belt. In the color image forming apparatus, to store the waste toner discharged from the plurality of cleaning devices, a long waste toner storing container is formed to extend along an alignment of the plurality of cleaning devices.

SUMMARY

A waste toner storing container according to an aspect of the present disclosure includes a container main body, a first conveyance portion, and a second conveyance portion. The container main body stores waste toner discharged from a plurality of image-carrying members provided in an image forming apparatus. The first conveyance portion is rotatably provided in the container main body and configured to, by being rotated, convey the waste toner toward one side in a direction along a rotation axis line. The second conveyance portion is rotatably provided below and parallel to the first conveyance portion in the container main body and configured to, by being rotated, convey the waste toner toward another side that is opposite to the one side.

This Summary is provided to introduce a selection of concepts in a simplified form that are further described below in the Detailed Description with reference where appropriate to the accompanying drawings. This Summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

DETAILED DESCRIPTION

The following describes an embodiment of an image forming apparatus according to the present disclosure with reference to the attached drawings. It should be noted that the embodiment described in the following is an example of a specific embodiment of the present disclosure and should not limit the technical scope of the present disclosure.

Figure 1:
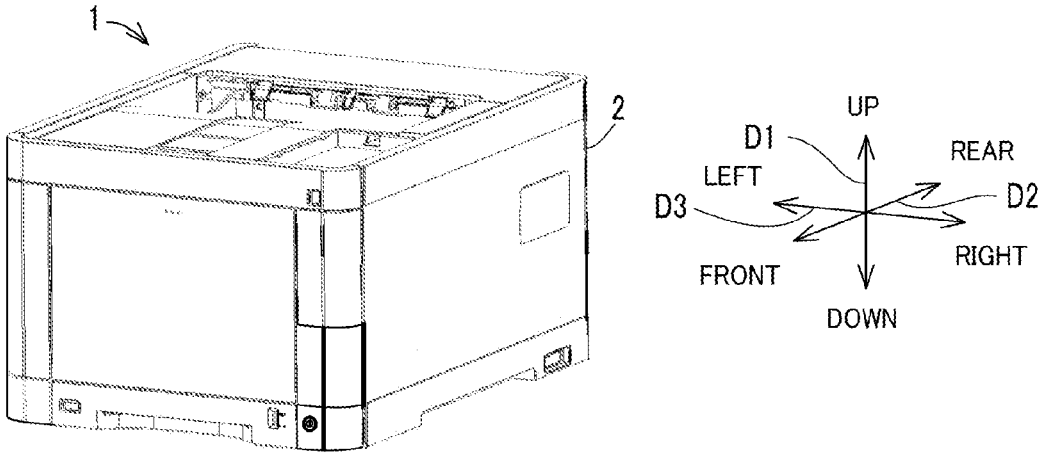
FIG. 1 is a diagram showing a configuration of an image forming apparatus according to an embodiment of the present disclosure.

It is noted that the present embodiment is described using an up-down direction D1, a front-rear direction D2, and a left-right direction D3 that are defined in FIG. 1 based on the normal use state of an image forming apparatus 1.

Figure 2:
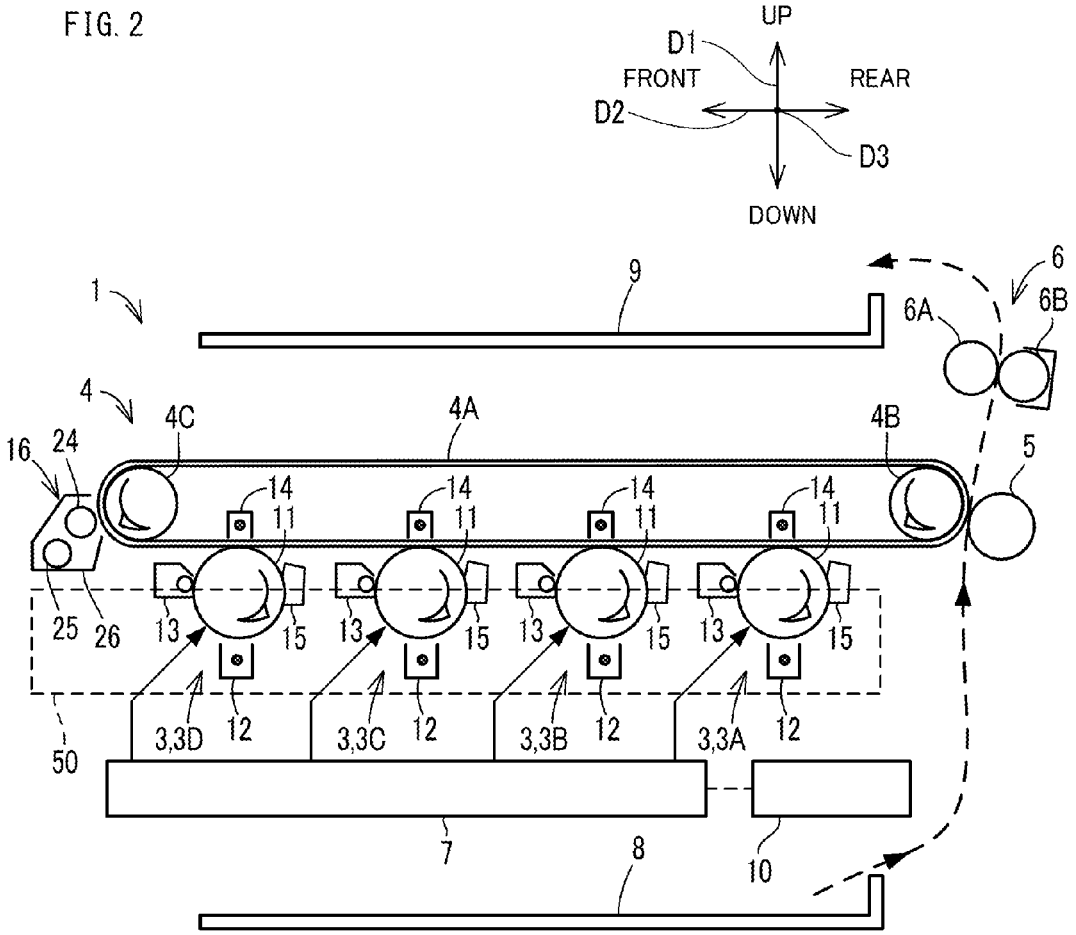
FIG. 2 is a diagram showing an internal configuration of the image forming apparatus of FIG. 1.

The image forming apparatus 1 is a so-called tandem color printer. As shown in FIG. 1, the image forming apparatus 1 includes a housing 2 that includes a cover of an external frame and an internal frame. In addition, as shown in FIG. 2, the image forming apparatus 1 includes a plurality of image forming portions 3, an intermediate transfer unit 4, a secondary transfer device 5, a fixing device 6, an exposure device 7, a sheet feed portion 8, a sheet discharge portion 9, a control portion 10, a belt cleaning device 16 (an example of the waste toner removing portion of the present disclosure), and a waste toner storing container 50.

The plurality of image forming portions 3 (3A-3D) are arranged in alignment in the front-rear direction D2. The plurality of image forming portions 3 respectively form toner images of different colors. In FIG. 2, the image forming portion 3A that is positioned in the most rear side forms a toner image by black toner. The image forming portion 3B, the second from the rear, forms a toner image by yellow toner. The image forming portion 3C, the third from the rear, forms a toner image by cyan toner. And the image forming portion 3D that is positioned in the most front side forms a toner image by magenta toner. Each of the image forming portions 3 includes a photoconductor drum 11 (an example of the image-carrying member of the present disclosure), a charging device 12, a developing device 13, a primary transfer device 14, and a drum cleaning device 15 (an example of the waste toner removing portion of the present disclosure). As a result, the image forming apparatus 1 includes a plurality of photoconductor drums 11, a plurality of developing devices 13, and a plurality of drum cleaning devices 15.

The intermediate transfer unit 4 includes an intermediate transfer belt 4A (an example of the image-carrying member of the present disclosure), a driving roller 4B, and a driven roller 4C. The intermediate transfer belt 4A carries a toner image that is formed from toner images of a plurality of (in the present embodiment, four) colors. Supported by the driving roller 4B and the driven roller 4C so as to be rotationally driven, the intermediate transfer belt 4A can move (run) in the state where its surface is in contact with the surfaces of the photoconductor drums 11. When the intermediate transfer belt 4A is rotationally driven, its surface passes through between the photoconductor drums 11 and the primary transfer devices 14. At that time, the toner images of respective colors are transferred in sequence from the photoconductor drums 11 to the surface of the intermediate transfer belt 4A in such a way as to be overlaid with each other.

The secondary transfer device 5 transfers the toner image transferred on the intermediate transfer belt 4A, to a print sheet that is conveyed from the sheet feed portion 8. The print sheet with the toner image transferred thereon is conveyed to the fixing device 6. The fixing device 6 includes a heating roller 6A and a pressure roller 6B. The fixing device 6 conveys the print sheet with the toner image transferred thereon while applying heat and pressure thereto. This allows the toner image to be fused and fixed to the print sheet. The print sheet with the toner image fixed thereto is further conveyed toward the downstream side, and then discharged onto and held by the tray-like sheet discharge portion 9 disposed in the upper part of the intermediate transfer unit 4.

The belt cleaning device 16 is disposed in front of the intermediate transfer unit 4. The belt cleaning device 16 includes a cleaning roller 24, a screw member 25, and a toner box 26, wherein the cleaning roller 24 is a cleaning member. The cleaning roller 24 is disposed to face the driven roller 4C, and its surface is in contact with the intermediate transfer belt 4A. The cleaning roller 24 is rotatably supported in the toner box 26. The cleaning roller 24 rotates when a rotation driving force is input to the spindle of the cleaning roller 24. The cleaning roller 24 has approximately the same length as the intermediate transfer belt 4A. The cleaning roller 24 removes toner that has remained on the surface of the intermediate transfer belt 4A after the transfer of the toner image by the secondary transfer device 5, by being rotated while contacting the intermediate transfer belt 4A. The removed toner (hereinafter referred to as "waste toner") is taken into the toner box 26 by the action of gravity or by the rotation of the cleaning roller 24. The waste toner taken into the toner box 26 is conveyed by the screw member 25. A discharge port 27 (see FIG. 4) is formed on the bottom of the toner box 26 in a right end portion thereof. The screw member 25 has helical blades around a cylindrical shaft member. Upon receiving the action of the blades while the screw member 25 is rotated, the waste toner is conveyed in the toner box 26 toward the discharge port 27. The waste toner is then discharged from the discharge port 27 to the outside. That is, the toner that has remained on the surface of the intermediate transfer belt 4A is removed by the belt cleaning device 16 and is discharged, as the waste toner, from the intermediate transfer belt 4A.

The plurality of image forming portions 3 have the same configuration except that they use toners of different colors respectively.

Each of the photoconductor drums 11 is a cylindrical rotation member with a photosensitive layer formed on its surface. The photoconductor drum 11 is rotatably supported in the housing 2, and rotates in a predetermined direction upon input of a rotation driving force. A toner image of a corresponding color is held on the surface of the photoconductor drum 11. Specifically, when the exposure device 7 exposes the surface of the photoconductor drum 11 to light in the state where the surface of the photoconductor drum 11 has been charged to a predetermined potential by the charging device 12, an electrostatic latent image is formed on the surface of the photoconductor drum 11. The electrostatic latent image is developed by the developing device 13 that is described below. This allows a toner image to be held on the surface of the photoconductor drum 11. The toner image on the photoconductor drum 11 is transferred onto the intermediate transfer belt 4A by the primary transfer device 14.

Figure 3:
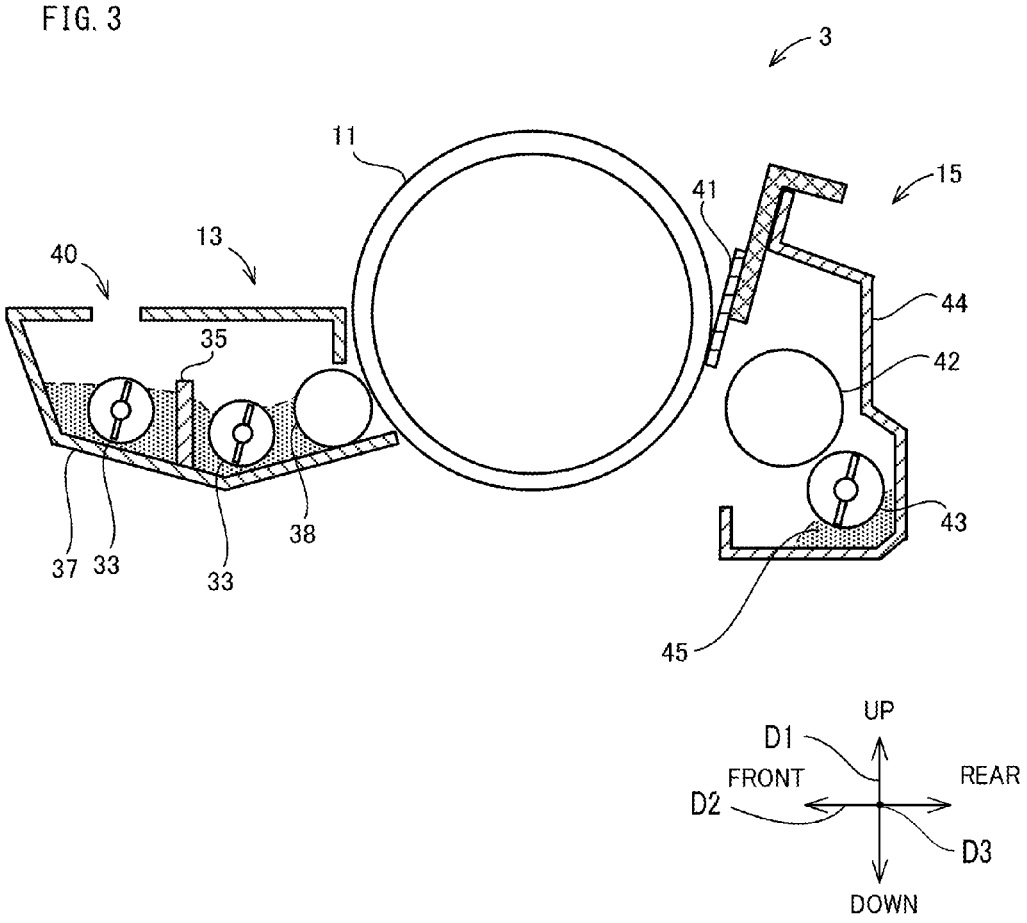
FIG. 3 is a diagram showing a configuration of an image forming unit included in the image forming apparatus of FIG. 1.

As shown in FIG. 3, each of the developing devices 13 visualizes, by developer, the electrostatic latent image formed on the surface of the photoconductor drum 11. The developing device 13 includes a developer case 37 and a magnet roller 38. The developer case 37 stores the developer that includes the toner. The magnet roller 38 is used for development and is rotatably supported in the developer case 37. A bias having the same polarity as the charging polarity of the photoconductor drum 11 is applied to the magnet roller 38. A stirring screw (not shown) is provided in the developer case 37. With the rotation of the stirring screw, the developer is stirred and the toner is charged to a predetermined potential. In addition, the charged toner is conveyed to a position that faces the photoconductor drum 11, and at the position, the toner is caused to fly toward the electrostatic latent image on the surface of the photoconductor drum 11. This allows the electrostatic latent image on the surface of the photoconductor drum 11 to be developed. The developer case 37 has a toner replenishing port 40, and the toner is replenished to the developer case 37 via the toner replenishing port 40 from a toner container (not shown).

Figure 4:
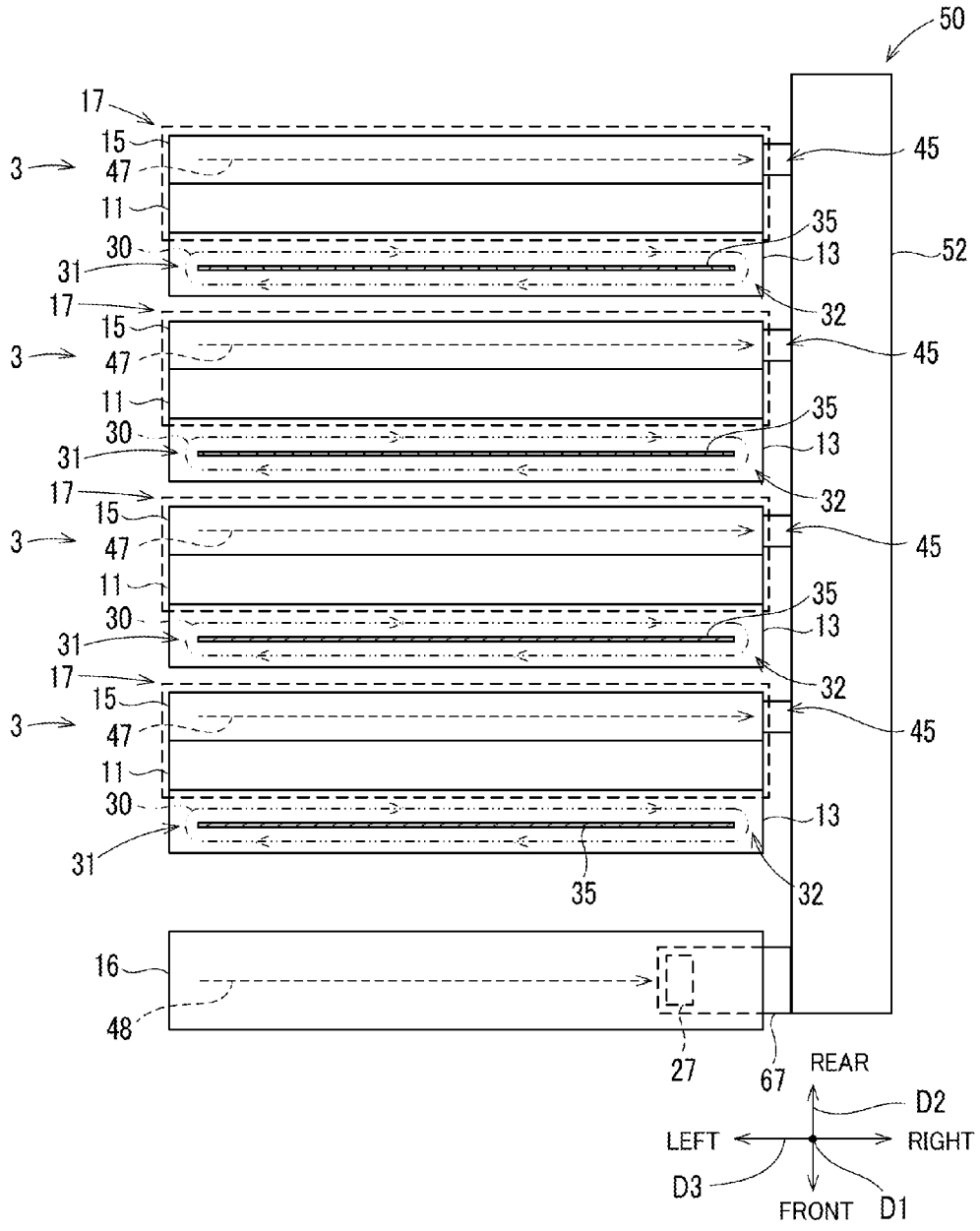
FIG. 4 is a diagram for explaining a toner flow path in which waste toner that has been removed from photoconductor drums and an intermediate transfer belt by cleaning devices flows before flowing into a waste toner storing container.

As shown in FIG. 4, the developer case 37 of the developing device 13 includes a partition wall 35. The partition wall 35 is erected on a bottom of the developer case 37 to extend along the longitudinal direction of the developer case 37 (a direction that matches the left-right direction D3). The inner space of the developer case 37 is partitioned into two spaces by the partition wall 35. The two spaces communicate with each other via communication portions 31 and 32 that are provided at opposite ends thereof in the longitudinal direction. In addition, the two spaces are each provided with a screw member 33 (see FIG. 3) that conveys the developer while stirring it. With the rotation of the screw members 33, the developer in the developer case 37 is conveyed to circulate in the two spaces along a circulation path 30 (see the two-dotted line in FIG. 4).

The drum cleaning device 15 is disposed in the rear side of the photoconductor drum 11. The drum cleaning device 15 is disposed for each of the photoconductor drums 11. The drum cleaning device 15 includes a cleaning blade 41 that is a cleaning member, a cleaning roller 42, a screw member 43, and a toner box 44. The cleaning blade 41 and the cleaning roller 42 have approximately the same length as the photoconductor drum 11. The edge of the cleaning blade 41 is disposed to be in contact with or close to the surface of the photoconductor drum 11. The cleaning roller 42 is rotatably supported in the toner box 44. The cleaning roller 42 rotates when a rotation driving force is input to the spindle of the cleaning roller 42. When the photoconductor drum 11 is rotated, the cleaning blade 41 removes toner that has remained on the surface of the photoconductor drum 11 after the transfer of toner image by the primary transfer device 14. The removed toner (hereinafter referred to as "waste toner") is taken into the toner box 44 by the action of gravity or by the rotation of the cleaning roller 42. The waste toner taken into the toner box 44 is conveyed by the screw member 43 in a discharge direction as indicated by the arrow 47 in FIG. 4. A discharge port 45 (see FIG. 4) is formed in the right-end side wall of the toner box 44. The screw member 43 has helical blades around a cylindrical shaft member. Upon receiving the action of the blades while the screw member 43 is rotated, the waste toner is conveyed in the toner box 44 toward the discharge port 45. The waste toner is then discharged from the discharge port 45 to the outside. That is, the toner that has remained on the surface of the photoconductor drum 11 is removed by the drum cleaning device 15 and is discharged, as the waste toner, from the photoconductor drum 11.

Each pair of the photoconductor drum 11 and the drum cleaning device 15 is unitized as a drum unit 17 (see FIG. 4). The discharge ports 45 included in the drum cleaning devices 15 project respectively from housings (not shown) of the drum units 17 to outside and are connected to reception ports 65 (65A-65D) of the waste toner storing container 50 that is described below.

As shown in FIG. 4, the waste toner removed by the drum cleaning device 15 is conveyed by the screw member 43 in the discharge direction (see the arrow 47) which is oriented rightward in the left-right direction D3 of the image forming apparatus 1. The waste toner that has been conveyed and arrived at the right end of the toner box 44 passes through the discharge ports 45 and the reception ports 65 (65A-65D) of the waste toner storing container 50, and is discharged into a container main body 52 that is described below.

In addition, the waste toner removed from the intermediate transfer belt 4A by the belt cleaning device 16 is conveyed by the screw member 25 in the discharge direction (see the arrow 48) which is oriented rightward in the left-right direction D3 of the image forming apparatus 1. The waste toner that has been conveyed and arrived at the right end of the toner box 26 passes through the discharge port 27 that is provided in the bottom of the toner box 26, passes through a reception port 65 (65E) of the waste toner storing container 50, and is discharged into the container main body 52 that is described below.

The waste toner storing container 50 is provided in the housing 2. As shown in FIG. 2, the waste toner storing container 50 is disposed below the intermediate transfer belt 4A. In addition, as shown in FIG. 4, the waste toner storing container 50 is disposed more on the right side than the right ends of the drum cleaning devices 15 and the belt cleaning device 16.

Figure 5:
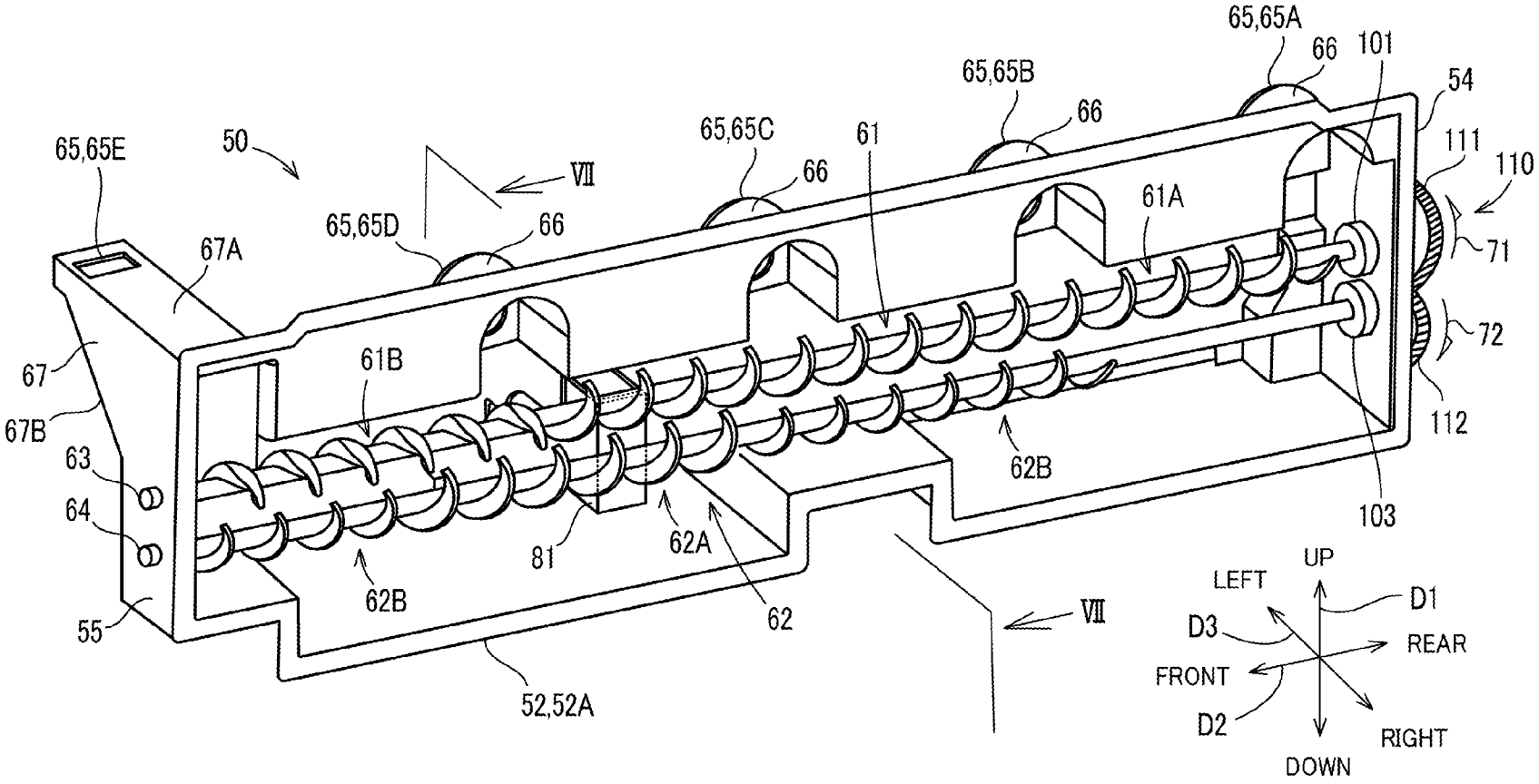
FIG. 5 is a diagram showing a configuration of the waste toner storing container according to an embodiment of the present disclosure.
Figure 6:
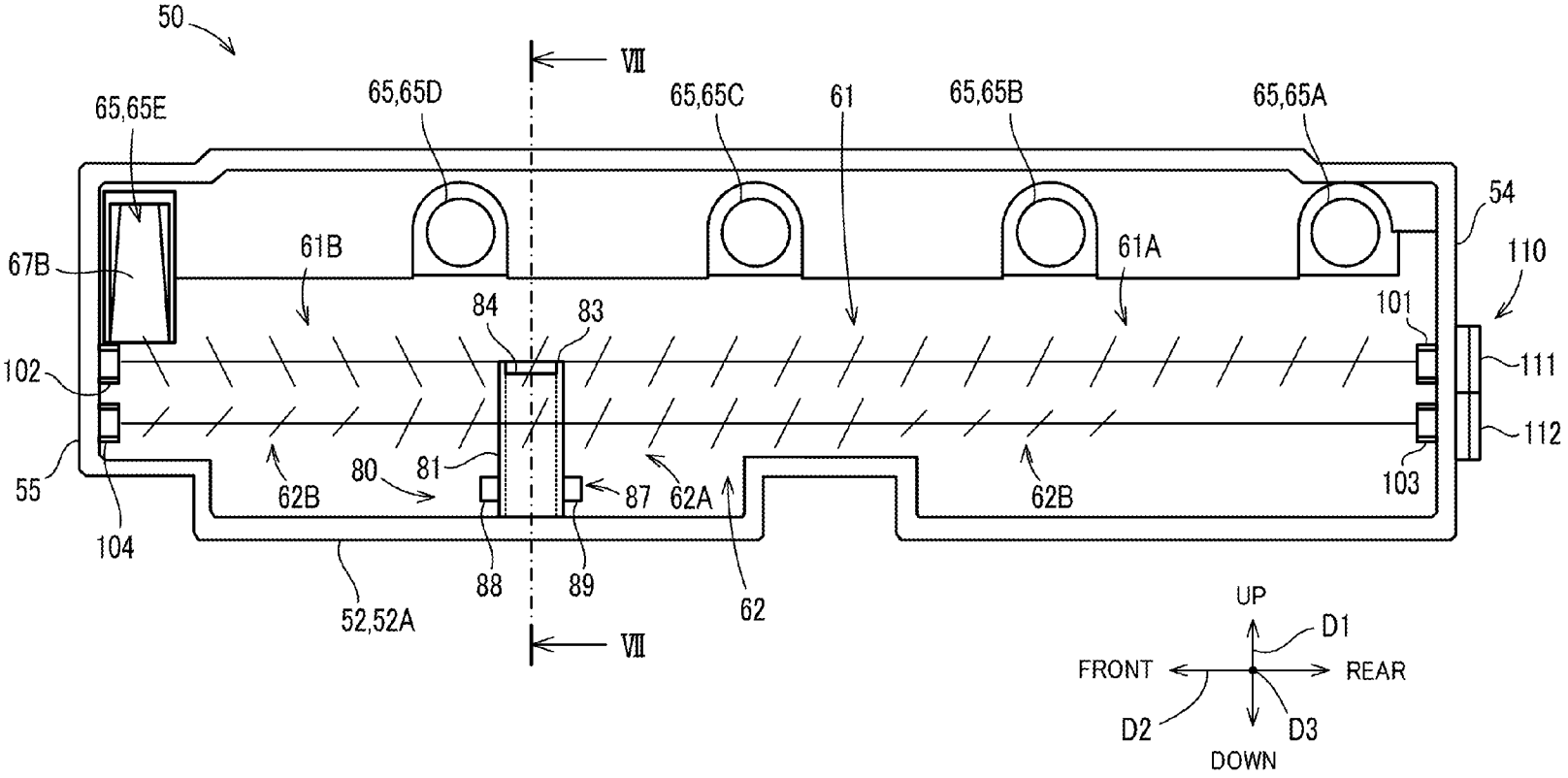
FIG. 6 is a diagram showing an internal configuration of the waste toner storing container of FIG. 5.
Figure 7:
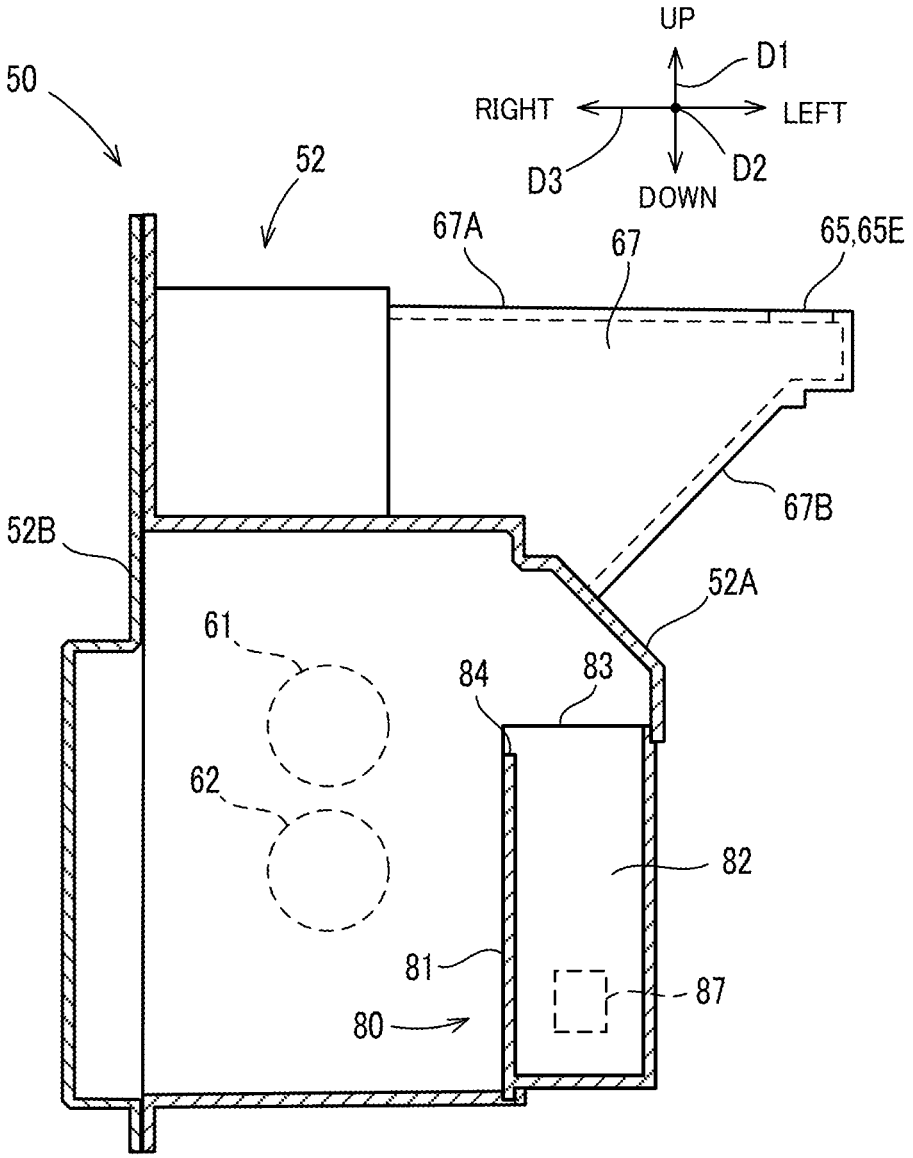
FIG. 7 is a cross-sectional diagram taken along a cut plane VII-VII shown in FIG. 5 and FIG. 6.

As shown in FIG. 5 to FIG. 7, the waste toner storing container 50 includes the container main body 52, an upper conveyance screw 61 (an example of the first conveyance portion and the third conveyance portion of the present disclosure), and a lower conveyance screw 62 (an example of the second conveyance portion of the present disclosure). It is noted that in FIG. 5, a cover portion 52B that constitutes a part of the container main body 52 is omitted for the sake of convenience in explanation.

The container main body 52 includes a main body case 52A and the cover portion 52B (see FIG. 7). The container main body 52 is long in the front-rear direction D2. The main body case 52A constitutes a left part of the container main body 52 (the image forming portions 3 side), and the cover portion 52B constitutes a right part of the container main body 52.

The waste toner discharged from the drum cleaning devices 15 and the belt cleaning device 16 is stored in the container main body 52. Specifically, as shown in FIG. 5, five reception ports 65 (65A-65E) are provided in the left side of the main body case 52A, and the waste toner flows in from the reception ports 65.

As shown in FIG. 5, four reception ports 65 (65A-65D) having the same shape are provided in the left side of the main body case 52A. The reception ports 65A-65D are provided at equal intervals in the front-rear direction D2, and disposed at approximately the same height position. The reception port 65A is positioned in the most rear side. The reception port 65A is disposed at a position corresponding to the image forming portion 3A that forms a black toner image, and is connected to the discharge port 45 of the drum cleaning device 15 of the image forming portion 3A. That is, the black waste toner that has been removed from the photoconductor drum 11 and discharged by the drum cleaning device 15 of the image forming portion 3A flows into the container main body 52 from the reception port 65A. Similarly, the reception port 65B is disposed at a position corresponding to the image forming portion 3B that forms a yellow toner image. The reception port 65C is disposed at a position corresponding to the image forming portion 3C that forms a cyan toner image. The reception port 65D is disposed at a position corresponding to the image forming portion 3D that forms a magenta toner image. The reception ports 65A-65D are respectively formed at the tips of cylindrical portions 66 that project leftward from the left side of the main body case 52A. The cylindrical portions 66 play a role of conveyance paths that guide the waste toner having entered the reception ports 65A-65D to an inside of the container main body 52.

In addition, the reception port 65E is positioned in the most front side of the left side of the main body case 52A. In the most front side of the left side of the main body case 52A, a guide portion 67 is provided to project leftward from the left side. An upper surface 67A of the guide portion 67 is horizontally flat, and the reception port 65E is formed in an end portion of the upper surface 67A at the tip of the projection. The reception port 65E is an opening that is opened upward. The inside of the guide portion 67 is hollow and the reception port 65E is communicated with the inside of the container main body 52. The bottom surface of the guide portion 67 is an inclined surface 67B that is inclined diagonally downward from the reception port 65E toward the inside of the container main body 52. The reception port 65E is formed at a position that corresponds to the belt cleaning device 16. Specifically, the reception port 65E is formed at a position where it can be connected to the discharge port 27 of the toner box 26. The discharge port 27 and the reception port 65E may be directly connected to each other or indirectly connected via a conveyance guide member (not shown) or the like. Accordingly, the waste toner that is discharged from the discharge port 27 flows into the reception port 65E. As a result, the waste toner that has been removed from the intermediate transfer belt 4A and discharged by the belt cleaning device 16 enters the reception port 65E, passes through the inside of the guide portion 67, and flows into the container main body 52 by sliding down on the inclined surface 67B.

Meanwhile, in the image forming apparatus 1, the primary transfer device 14 and the drum cleaning device 15 transfer toner images at approximately the same transfer rate. As a result, when a comparison is made between the amount of residual toner on a single photoconductor drum 11 after the transfer and the amount of residual toner on the intermediate transfer belt 4A after the transfer, it is found that the amount of residual toner on the intermediate transfer belt 4A is larger than the amount of residual toner on a single photoconductor drum 11 since toner images of a plurality of colors are overlaid on the intermediate transfer belt 4A. For example, suppose that the same amount of toner is used for each color and that the transfer rate is 90%, then the amount of toner discharged from the intermediate transfer belt 4A is 3.6 times the amount of toner discharged from a single photoconductor drum 11. That is, among the five reception ports 65 (65A-65E), a reception port having the highest inflow rate of waste toner is the reception port 65E that is disposed in the most front side. In other words, among the plurality of photoconductor drums 11 and the intermediate transfer belt 4A, an image-carrying member having the largest discharge amount of waste toner is the intermediate transfer belt 4A. In this way, there is a deviation in the inflow rate when the waste toner flows in from the five reception ports 65, thus the bulk of the waste toner in the container main body 52 is uneven in the longitudinal direction of the container main body 52. That is, the bulk of the waste toner having flowed in from the reception port 65E is higher than the bulk of the waste toner that has flowed in from each of the other reception ports. In this case, the reception port 65E is clogged with waste toner even if there is an empty space in the container main body 52, and inflow of the waste toner from the reception port 65E is interrupted. Accordingly, in the present embodiment, to eliminate a malfunction caused by the deviation in the inflow amount, the upper conveyance screw 61 is provided in the container main body 52, and the lower conveyance screw 62 is further provided below the upper conveyance screw 61.

The upper conveyance screw 61 and the lower conveyance screw 62 are rotatably provided in the container main body 52.

The upper conveyance screw 61 is rotatably provided in the container main body 52 at the medium in the up-down direction D1. The upper conveyance screw 61 is rotatably supported by bearings 101 and 102 in the state of passing through side walls 54 and 55 provided at opposite ends in the longitudinal direction and being suspended between the side walls 54 and 55. The upper conveyance screw 61 is rotationally driven by a driving motor (not shown) via a drive transmission mechanism 110 that is described below. By being rotated, the upper conveyance screw 61 conveys the waste toner in the container main body 52 in a direction along the rotation axis line.

In the present embodiment, the upper conveyance screw 61 includes a rear-side conveyance portion 61A and a front-side conveyance portion 61B. In the upper conveyance screw 61, the rear-side conveyance portion 61A and the front-side conveyance portion 61B are disposed on the same axis. That is, the rear-side conveyance portion 61A is positioned in rear of the front-side conveyance portion 61B. The rear-side conveyance portion 61A is an example of the first conveyance portion of the present disclosure, and by being rotated, conveys the waste toner frontward (corresponding to "toward one side" of the present disclosure) along the rotation axis line. In addition, the front-side conveyance portion 61B is provided in the front side of the upper conveyance screw 61. That is, the front-side conveyance portion 61B is adjacent to the front portion of the rear-side conveyance portion 61A in the direction along the rotation axis line. The front-side conveyance portion 61B is an example of the third conveyance portion of the present disclosure, and by being rotated, conveys the waste toner rearward (corresponding to "toward another side that is opposite to the one side" of the present disclosure) along the rotation axis line. The conveyance of the waste toner is realized by the helical blades formed on the upper conveyance screw 61. In the present embodiment, the blades of the rear-side conveyance portion 61A and the blades of the front-side conveyance portion 61B are formed at different angles. With this configuration, when the upper conveyance screw 61 is rotated, the rear-side conveyance portion 61A and the front-side conveyance portion 61B convey the waste toner in different directions (opposite directions).

It is noted that although the present embodiment describes the configuration where the upper conveyance screw 61 includes the rear-side conveyance portion 61A and the front-side conveyance portion 61B, the upper conveyance screw 61 may not include the front-side conveyance portion 61B. That is, the upper conveyance screw 61 may include only the rear-side conveyance portion 61A.

The lower conveyance screw 62 is rotatably provided in the lower side of the container main body 52 in the up-down direction D1. Specifically, the lower conveyance screw 62 is provided below and parallel to the upper conveyance screw 61. The lower conveyance screw 62 is rotatably supported by bearings 103 and 104 in the state of passing through side walls 54 and 55 provided at opposite ends in the longitudinal direction and being suspended between the side walls 54 and 55. The lower conveyance screw 62 is rotationally driven by a driving motor (not shown) via the drive transmission mechanism 110 that is described below. By being rotated, the lower conveyance screw 62 conveys the waste toner in the bottom side of the container main body 52 rearward along the rotation axis line. The lower conveyance screw 62 is rotated such that the waste toner that has flowed in from the reception port 65E is conveyed rearward so as to be separated from the reception port 65E.

Meanwhile, among the waste toner stored in the container main body 52, waste toner in the upper layer is lower than waste toner in the lower layer in toner density under the influence of its own weight. Accordingly, when it is supposed that the upper conveyance screw 61 and the lower conveyance screw 62 have the same conveyance force, the amount of actually conveyed waste toner is deviated therebetween. Specifically, the amount of waste toner conveyed by the lower conveyance screw 62 is larger than the amount of waste toner conveyed by the upper conveyance screw 61. In view of this, in the present embodiment, the conveyance force of the upper conveyance screw 61 for conveying waste toner is set to be larger than the conveyance force of the lower conveyance screw 62. Specifically, the conveyance force may be made different between the upper conveyance screw 61 and the lower conveyance screw 62 by making the blades thereof different in size or inclination angle. Alternatively, the rotation speed may be made different between the upper conveyance screw 61 and the lower conveyance screw 62. With such a configuration, a deviation in the amount of actually conveyed waste toner between the upper conveyance screw 61 and the lower conveyance screw 62 is reduced. It is noted that the conveyance force may be represented by an amount of waste toner moving per unit time (an amount of conveyance).

The side wall 54 is provided with a drive transmission mechanism 110. The drive transmission mechanism 110 includes a gear 111 and a gear 112. The gear 111 is connected to an end portion of a rotation shaft 63 of the upper conveyance screw 61 that has passed through the side wall 54 to the outside, and is provided on the same axis as the upper conveyance screw 61. The gear 112 is connected to an end portion of a rotation shaft 64 of the lower conveyance screw 62 that has passed through the side wall 54 to the outside, and is provided on the same axis as the lower conveyance screw 62. The gear 111 and the gear 112 mesh with each other. The gear 111 is connected to the driving motor via an idle gear such that the drive can be transmitted. When a rotation driving force of the driving motor is transmitted to the drive transmission mechanism 110, the gear 111 is rotated in a direction of the arrow 71, and the upper conveyance screw 61 is rotated in the same direction. This allows the rear-side conveyance portion 61A to convey the waste toner frontward and the front-side conveyance portion 61B to convey the waste toner rearward. On the other hand, the gear 112 is rotated in a direction (indicated by the arrow 72) opposite to the rotation direction of the gear 111, and the lower conveyance screw 62 is rotated in the same direction. With this configuration, the lower conveyance screw 62 can convey the waste toner to the rear side.

Figure 8A:
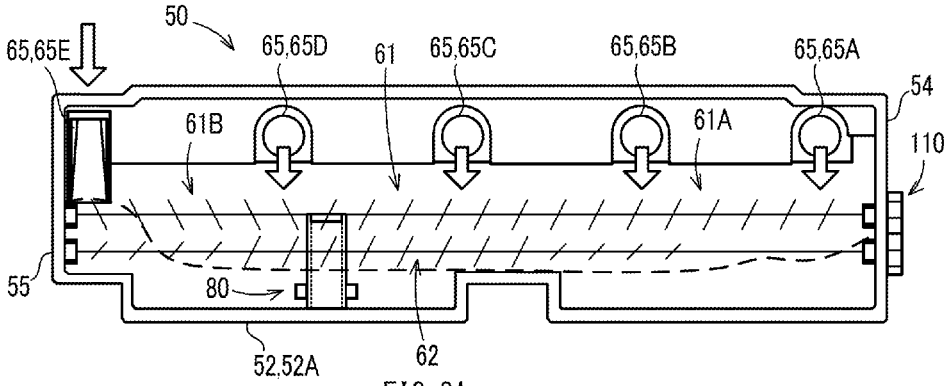
FIG. 8A-FIG. 8C are diagrams showing states where the waste toner is stored in the waste toner storing container according to an embodiment of the present disclosure.
Figure 8B:
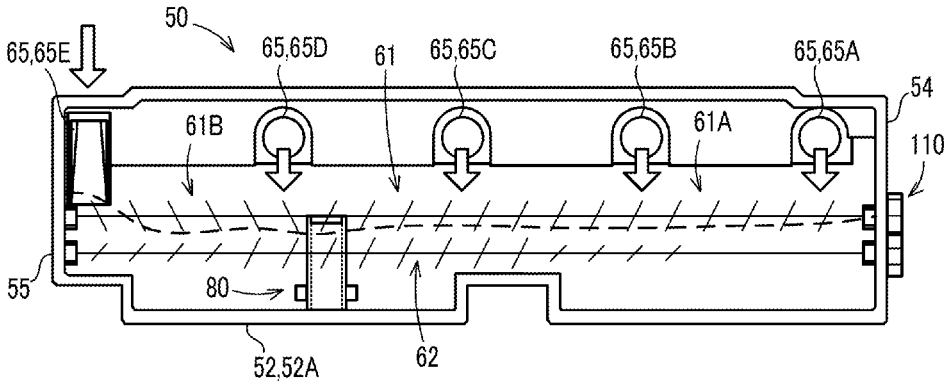

As described above, since the upper conveyance screw 61 and the lower conveyance screw 62 are disposed separated from each other in the vertical direction in the waste toner storing container 50, in the bottom side of the container main body 52, the waste toner is conveyed rearward by the lower conveyance screw 62, and in the upper layer of the container main body 52, the waste toner is conveyed frontward by the upper conveyance screw 61. With this configuration, even in a state where a small amount of waste toner is stored in the container main body 52 as indicated by the dotted line in FIG. 8A, the bulk of the waste toner stored in the container main body 52 is made even in the front-rear direction D2 by the conveyance of the lower conveyance screw 62. In addition, in a state where inflow of the waste toner has gradually increased and a relatively large amount of waste toner is stored in the container main body 52, the bulk of the waste toner stored in the container main body 52 is made even by the conveyances of both the upper conveyance screw 61 and the lower conveyance screw 62, as indicated by the dotted line in FIG. 8B. That is, the bulk of the waste toner is made to have an equal height. As a result of this, the container main body 52 does not have any wasteful space inside, and the waste toner can be efficiently filled in the space in the container main body 52.

In particular, with the configuration where the lower conveyance screw 62 always conveys the waste toner rearward in the bottom part of the container main body 52, even when a large amount of waste toner flows in from the reception port 65E, the waste toner is conveyed such that the bulk of waste toner is equal over the whole container main body 52.

Meanwhile, when the waste toner storing container 50 becomes full of waste toner, the waste toner storing container 50 needs to be replaced. As a result, in the present embodiment, a detection mechanism 80 is provided in the container main body 52, wherein the detection mechanism 80 detects that the waste toner storing container 50 is full of waste toner. As shown in FIG. 6, the detection mechanism 80 includes a partition wall portion 81 and a detection portion 87.

The partition wall portion 81 forms an inner space 82 that is separated from the waste toner storage space in the container main body 52, and is provided in the container main body 52. Specifically, the partition wall portion 81 is formed in a rectangular shape extending upward from the bottom of the container main body 52. As shown in FIG. 7, the upper end of the partition wall portion 81 is opened, forming an opening portion 83. At the right end of the opening portion 83, a cut 84 is formed. The cut 84 is an inlet from which waste toner flows into the inner space 82 when the waste toner stored in the container main body 52 exceeds a predetermined storage amount. In the present embodiment, the upper end position of the partition wall portion 81 is set to a position that corresponds to a limit height of waste toner stored in the container main body 52. More specifically, the cut 84 is formed in the partition wall portion 81 at a position that matches the limit height of waste toner stored in the container main body 52. The limit height of waste toner stored in the container main body 52 is a height position of a bulk of waste toner when the container main body 52 is evaluated as full. The limit height of waste toner is determined from a factor such as the storage volume of the container main body 52 or the height of the reception ports 65. As shown in FIG. 6, in the present embodiment, the position of the upper end of the partition wall portion 81 is set to a height position that is approximately the same as the center of the upper conveyance screw 61.

As shown in FIG. 7, the partition wall portion 81 is disposed in the left side of the container main body 52, and is disposed more in the left side than the upper conveyance screw 61 and the lower conveyance screw 62. Specifically, the partition wall portion 81 is disposed adjacent to the left side wall of the container main body 52 that extends in the longitudinal direction. The partition wall portion 81 forms the inner space 82 between itself and the left side wall of the container main body 52.

The detection portion 87 is provided in the partition wall portion 81. The detection portion 87 detects that the container main body 52 is full when an amount of waster toner that allows the container main body 52 to be evaluated as full is stored in the storage space of the container main body 52. The detection portion 87 is, for example, composed of a light emitter 88 and a light receptor 89. In the partition wall portion 81, the light emitter 88 and the light receptor 89 are respectively provided on side walls that face each other across the inner space 82. When the container main body 52 becomes full of waste toner and the waste toner enters the inner space 82 from the cut 84, the waste toner having entered the inner space 82 blocks the light path from the light emitter 88 to the light receptor 89. The light receptor 89 is connected to the control portion 10, and the control portion 10 determines whether or not the waste toner has entered the inner space 82 based on a level change of a signal from the light receptor 89.

Figure 8C:
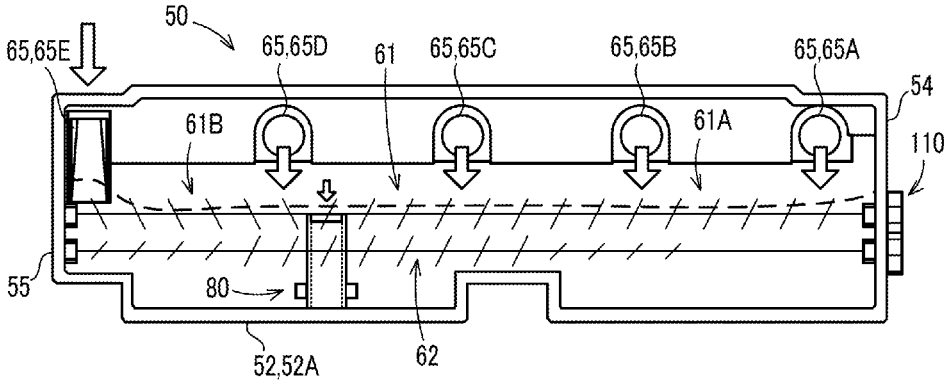

Since the detection mechanism 80 is provided in the waste toner storing container 50 as described above, it is possible, as shown in FIG. 8C, to detect correctly that the container main body 52 is full of waste toner, without making any wasteful space in the container main body 52.

In the present embodiment, the partition wall portion 81 is disposed closer to the center of the container main body 52 than to an end thereof in the longitudinal direction (a direction that matches the rotation axis line of the upper conveyance screw 61). Specifically, as shown in FIG. 6, the partition wall portion 81 is disposed between the reception port 65D and the reception port 65C, at a position closer to the reception port 65D. This position is away from the front end by approximately one third of the length of the container main body 52 in the longitudinal direction. As described above, a more amount of waste toner flows in from the reception port 65E than from each of the other reception ports 65A-65D. That is, there is a deviation in the inflow rate among the reception ports 65. As a result, the partition wall portion 81 is disposed at such a position that divides the container main body 52 into two parts in the front-rear direction D2 such that an approximately equal amount of waste toner flows into each of the two parts from the reception ports 65. That is, a total of inflow amounts of waste toner from the reception ports 65A-65C positioned in the rear side of the partition wall portion 81 is approximately the same as a total of inflow amounts of waste toner from the reception ports 65D and 65E positioned in the front side of the partition wall portion 81.

When the partition wall portion 81 is disposed at such a position, the rear-side conveyance portion 61A of the upper conveyance screw 61 conveys the waste toner having flowed in from the reception ports 65A-65C, frontward toward the partition wall portion 81. In addition, the front-side conveyance portion 61B of the upper conveyance screw 61 conveys the waste toner having flowed in from the reception ports 65D and 65E, rearward toward the partition wall portion 81. With this configuration, the waste toner is stored in a flat state in the container main body 52. In addition, it can be detected in an early stage that the container main body 52 is full of waste toner.

Furthermore, with the configuration including the partition wall portion 81, it is desired that the conveyance force of the lower conveyance screw 62 changes depending on the position in the direction along the rotation axis line. In the lower conveyance screw 62 of the present embodiment, the conveyance force of blades 62A in the vicinity of the partition wall portion 81 is larger than the conveyance force of the other blades 62B. Specifically, the blades are formed such that the blades 62A are larger in size than the blades 62B, and the angle of the blades 62A with respect to the rotation shaft 64 is larger than the angle of the blades 62B. With this configuration, even when waste toner is excessively conveyed to the vicinity of the partition wall portion 81, the waste toner is smoothly conveyed in a direction to be separated from the partition wall portion 81. It is noted that, to make the conveyance force of the blades 62A larger than that of the blades 62B, the arrangement interval of the blades 62A may be made shorter than the arrangement interval of the blades 62B. In addition, the blades 62A may be made larger than the blades 62B in either size or angle.

In the above-described embodiment, the image forming apparatus 1 includes a plurality of photoconductor drums 11 and the intermediate transfer belt 4A. However, the present disclosure is not limited to this configuration. For example, the present disclosure is applicable to an image forming apparatus that includes a plurality of photoconductor drums 11, but not the intermediate transfer belt 4A, wherein toner images are directly transferred from the plurality of photoconductor drums 11 onto a print sheet. In that case, since, in general, black toner is used by the largest amount among the plurality of colors of toner, the largest amount of waste toner flows in from the reception port 65A that is positioned in the most rear side, among the four reception ports 65 (65A-65D). In other words, among the plurality of photoconductor drums 11, the image-carrying member that discharges the largest amount of waste toner is the photoconductor drum 11 corresponding to the image forming portion 3A. In this configuration, the upper conveyance screw 61 conveys the waste toner in the container main body 52 rearward, and the lower conveyance screw 62 conveys the waste toner in the container main body 52 frontward. That is, the lower conveyance screw 62 conveys the waste toner frontward so that the waste toner is separated from the reception port 65A.

Furthermore, in the above-described embodiment, the image forming apparatus 1 includes a plurality of image-carrying members such as the plurality of photoconductor drums 11 and the intermediate transfer belt 4A. However, the present disclosure is not limited to a specific combination of a plurality of image-carrying members. That is, the present disclosure is applicable to, for example, an image forming apparatus that includes one photoconductor drum 11 and one intermediate transfer belt 4A, or an image forming apparatus that includes at least two photoconductor drums 11.

It is to be understood that the embodiments herein are illustrative and not restrictive, since the scope of the disclosure is defined by the appended claims rather than by the description preceding them, and all changes that fall within metes and bounds of the claims, or equivalence of such metes and bounds thereof are therefore intended to be embraced by the claims.

The invention claimed is:

1. A waste toner storing container comprising:

a container main body configured to store waste toner discharged from a plurality of image-carrying members provided in an image forming apparatus;

a first conveyance portion rotatably provided in the container main body and configured to, by being rotated, convey the waste toner toward one side in a direction along a rotation axis line, a second conveyance portion rotatably provided below and parallel to the first conveyance portion in the container main body and configured to, by being rotated, convey the waste toner toward another side that is opposite to the one side, a partition wall portion provided in the container main body and extending upward from a bottom of the container main body in such a way as to form an inner space that is separated from a waste toner storage space in the container main body;

a detection portion configured to detect that the waster toner stored in the waste toner storage space has entered the inner space of the partition wall portion from an opening provided in an upper part of the partition wall portion; and a third conveyance portion provided adjacent to a part of the first conveyance portion that is on the one side in the direction along the rotation axis line, and configured to convey the waste toner toward the other side that is opposite to the one side, wherein the partition wall portion is disposed closer to a center of the container main body than to an end thereof in the direction along the rotation axis line, the first conveyance portion conveys the waste toner toward the one side toward the partition wall portion, the third conveyance portion conveys the waste toner toward the other side toward the partition wall portion, and in the second conveyance portion, a conveyance force of a part thereof in a vicinity of the partition wall portion is larger than a conveyance force of the other part thereof.

2. An image forming apparatus comprising:

the waste toner storing container according to claim 1;

a plurality of image-carrying members configured to carry toner images respectively; and a plurality of waste toner removing portions configured to remove waste toner from surfaces of the plurality of image-carrying members and discharge the removed waste toner to the waste toner storing container.

* * * * *